United States Patent [19]

Meyers

[11] Patent Number: 4,527,830

[45] Date of Patent: Jul. 9, 1985

[54] INFANT SEAT AND TABLE AND SUPPLY CARRIER

[76] Inventor: Roger A. Meyers, 1150 B. Westlake Blvd., Westlake Village, Calif. 91361

[21] Appl. No.: 491,575

[22] Filed: May 4, 1983

[51] Int. Cl.[3] ..... A47C 7/62

[52] U.S. Cl. ..... 297/192; 297/17; 297/193

[58] Field of Search ..... 297/192, 193, 118, 129, 297/17; 5/2 R, 2 B, 3, 4, 5; 324/158, 161, 208, 202, 205

[56] References Cited

U.S. PATENT DOCUMENTS

| | | | |
|---|---|---|---|
| 1,900,847 | 3/1933 | Siday | 297/192 X |
| 2,357,314 | 8/1944 | McDole | 297/192 |
| 3,269,621 | 8/1966 | Dishart | 297/192 X |
| 3,545,809 | 12/1970 | Krenz | 297/192 X |
| 3,934,934 | 1/1976 | Farrell, Jr. et al. | 297/254 |
| 4,238,049 | 12/1980 | Lehmann et al. | 220/331 |

*Primary Examiner*—James T. McCall

*Attorney, Agent, or Firm*—Koppel & Harris

[57] ABSTRACT

A device for transporting infant supplies and for supporting an infant includes a main body that has upright walls extending from a base for forming a central cavity. The top of the cavity is closed by an upper support surface. A portion of at least two of the walls extend above the upper support surface, and the infant support member of two table members hinged relative to each other are mounted on the infant support surface. The shafts about which the tables hinge extend outward and engages slots in portions of the upright walls above the support surface. The table members slide through their connection with the hinge shafts through the slot. At one end of the slot when the table members are folded over each other, the table members are nested above the main body. At the other end of the slot, when the table members are open, the central pivot is generally centrally located on the main body to prevent tipping of the device.

16 Claims, 12 Drawing Figures

Fig.4.
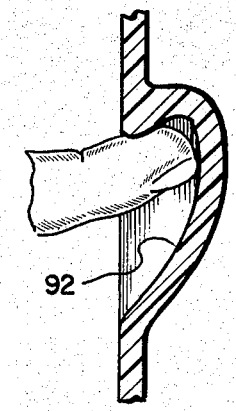
Fig.5.
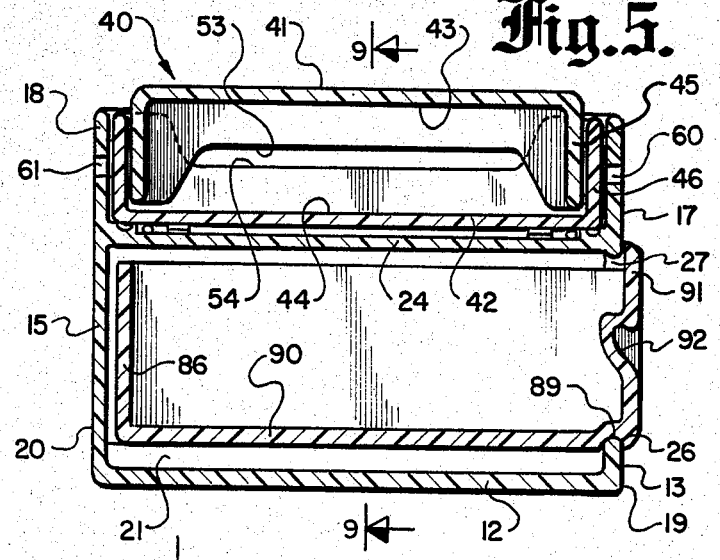
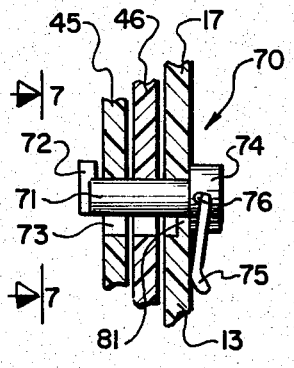
Fig.6.
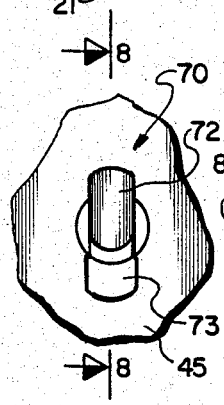
Fig.7.
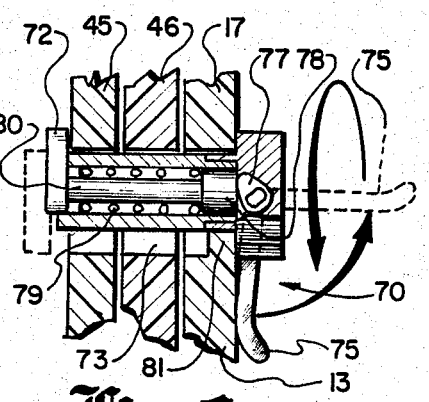
Fig.8.
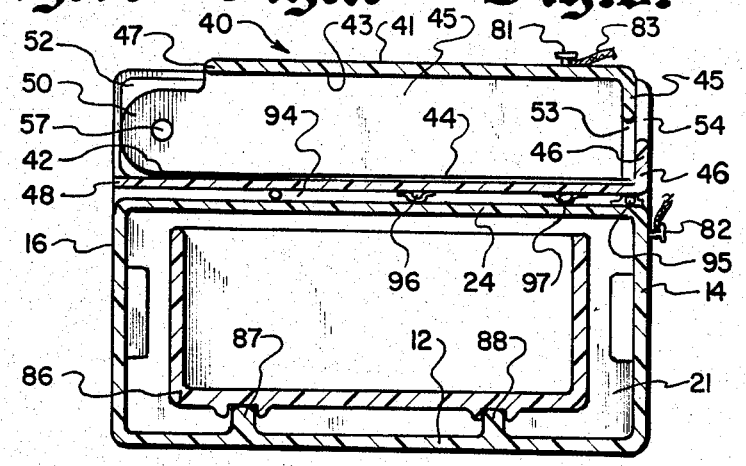
Fig.9.

97
42
96
94
95
24
14
13
51
64
60
10
40
49
57
65
63
17
16
58
50
52
23
55
41
15

INFANT SEAT AND TABLE AND SUPPLY CARRIER

BACKGROUND OF THE INVENTION

1. Field of the Invention

This invention relates to a device for carrying supplies normally used by infants, which when stationary also supports an infant in positions for sleeping, sitting or for changing clothes or diapers.

2. Description of the Prior Art

Leaving the house with a baby can create many difficulties for a parent. It is not uncommon to carry many changes of clothing and diapers. Frequently, food, bottles, lotions and powders are also carried. There are a wide range of products on the market for carrying baby supplies ranging from carriers especially suited for insulating hot or cold baby food to simple duffel bags and other luggage-like objects.

There are also many infant seats. Many have adjustable backs that can be raised and lowered. In the flat, lowered position, an infant can sleep. Some can be used for diaper and clothing changes. A more upright position, especially a vertical one, is appropriate only for an older infant who can keep his or her head erect.

The difficulty arises in transporting the clothing and food and the infant seat while also carrying the baby. The problem can be even more compounded if one wants to carry other objects such as a purse, a camera or the like.

SUMMARY OF THE INVENTION

One of the objects of the present invention is to disclose and provide a device that will carry the supplies needed for an infant and double as a seat, bed or changing table and package it such that the device can be carried easily even without occupying one's hands. Another object of the present invention is to construct such a device with various safety features to protect both the user and the infant but to make the device versatile and convenient to use.

Another object of the present invention is to disclose and provide a device for transporting infant supplies and for supporting an infant with a hinged top that opens into the seat or bed or table and which can be properly positioned for balance above the rest of the device. Another object is to disclose and provide in the device a means for locking the tops to the device. A further object is to disclose and provide an opening which may be in the form of a drawer into the central part of the device for access to the infant supplies. A further object is to supply a device with many convenience features but to make it relatively light weight.

The present invention for transporting infant supplies and for supporting an infant has a main body. The main body has upright walls, at least two of them being parallel extending up from a base and forming a central cavity. An upper support surface extends inward from the upright walls below the top edge of the upright walls. An infant support member comprising a pair of table members hinging over each other is on the upper support surface and is secured to the upright wall by means of a slot extending along each of the parallel upright walls. The securing means comprises a shaft extending through upstanding walls on each table member to act as a pivot. Each shaft has an extension extending to the slots to act as the securing means. In the stored position, the pivot shaft rests in downward extensions from the slot. When one of the table members is opened relative to the other to their flat position, the shafts are moved upwared and slide along the slot until they are approximately centrally located along the main body.

A locking system is provided to hold the table members in their nested position.

One of the upstanding walls has an opening for access to the central cavity of the main body. The opening may either have a door covering it, or a drawer may slide in and out of the opening.

These and other objects of the invention will be apparent from the detailed description.

BRIEF DESCRIPTION OF THE DRAWINGS

FIG. 1 is a perspective view of the device for transporting infant supplies and for supporting an infant of the present invention.

FIGS. 2, 3, and 4 are sectional views of certain details of the device of the present invention. FIG. 2 is a sectional view taken through plane 2—2 in FIG. 1 showing in detail the hinge mechanism of the two table members. FIG. 3 is a sectional view taken through plane 3—3 of FIG. 1 showing detail in the means for securing the carrying strap to the device. FIG. 4 is a sectional view taken through plane 4—4 of FIG. 1 showing the details of the drawer handle.

FIG. 5 is a side, sectional view of the device of the present invention taken through plane 5—5 of FIG. 1.

FIGS, 6, 7, and 8 are views of the details of the system for locking the table members to the main body of the present invention. FIG. 6 is a sectional view taken through plane 6—6 of FIG. 1, FIG. 7 is also a sectional view looking through 7—7 of FIG. 6, and FIG. 8 is another sectional view taken through plane 8—8 of FIG. 7.

FIG. 9 is a front sectional view taken through plane 9—9 of the device of the present invention.

DETAILED DESCRIPTION OF THE PREFERRED EMBODIMENT

The device for transporting infant supplies and for supporting an infant comprises a main body 10 (FIGS. 1, 5, 9 and 10). The main body comprises upright wall means comprising a plurality of generally upright walls connected on their sides to adjacent upright walls forming a central cavity inside the upright walls. In the exemplary embodiment, upright walls 13, 14, 15 and 16 (FIGS. 1, 5, 10 and 11) extend upward from base 12 (FIGS. 5 and 9). Although the base is not necessary, it adds strength and helps form central cavity 21 (FIGS. 5 and 9). Base 12 in the exemplary embodiment is square or slightly rectangular, but various shapes are possible.

Figures 1, 2, 3:
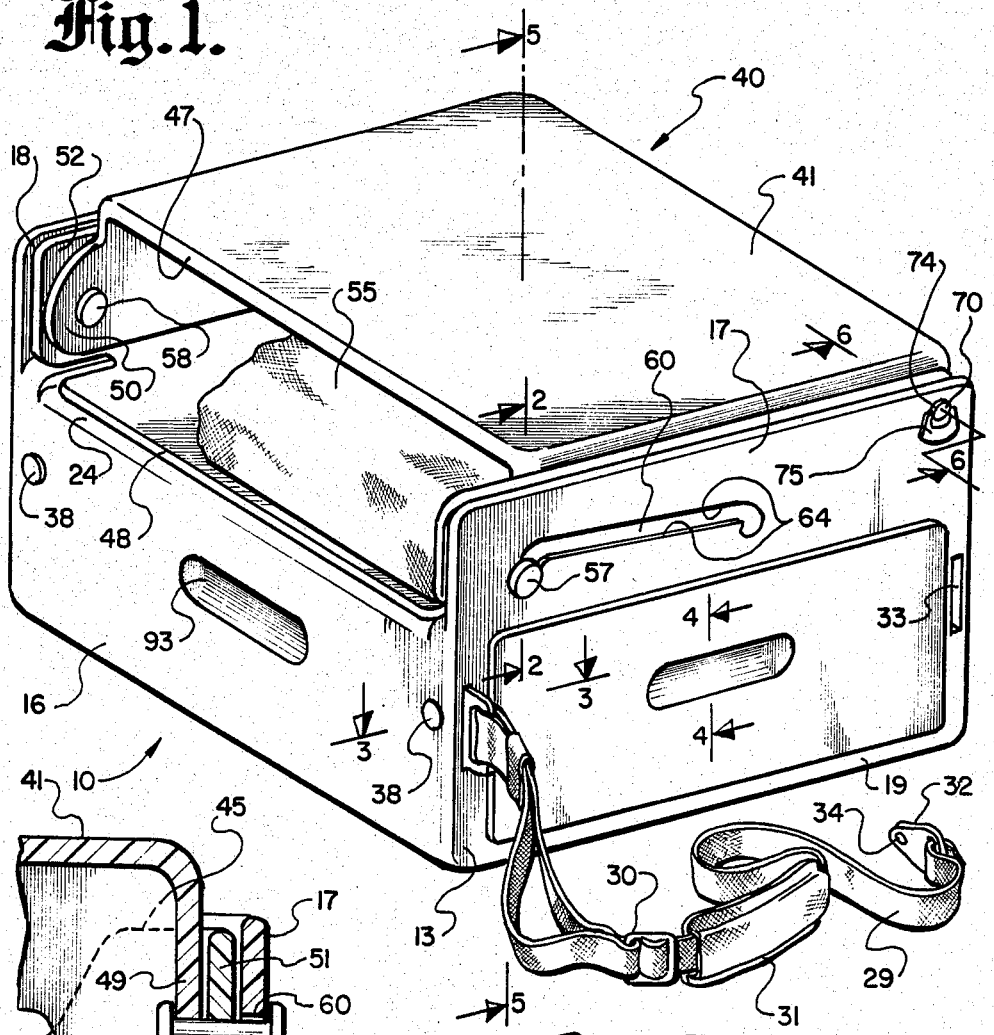

The upright walls and the base can be formed of a wide variety of material. Plastic is preferred because of its light weight, high strength, and ease of forming. Although not shown in the drawings, upright walls 13–16 and base 12 or the edges of them may be padded. Two of the upright walls, walls 13 and 15, which are parallel to each other, have an upper portion 17 and 18 and a lower portion 19 and 20 respectively (FIGS. 1, 5 and 10). An upper support surface 24 extending inward from the upright walls is the dividing line between the upper portions 17 and 18 and the lower portions 19 and 20 of upright walls 13 and 15 respectively. In the exemplary embodiment, upper support surface 24 (FIGS. 1, 5 and 9) extends entirely over the area between upright walls 13 and 17 to close the top of cavity 21 and prevent items stored within the cavity from falling through the top of the cavity. Upper support surface only has to extend inward slightly from walls 13 and 15.

The infant support member, which is on the upper support surface 24, comprises a pair of table members hinging over each other. In the exemplary embodiment, infant support member 40 (FIGS. 1, 4, 9, 10 and 11) comprises an upper table member 41 and a lower table member 42. The references to upper and lower are for convenience only and relate to the manner in which the table members are stored in their nested position (FIGS. 1, 5 and 9). Upper table 41 has a generally flat table surface 43 (FIGS. 5 and 9) with a lip 45 extending around three sides of the upper table. Edge 47 has no lip. Lower table 42 is of somewhat similar construction having a generally flat table surface 44 surrounded on three sides by lip 46. Edge 48 has no lip. At one end of each of the upper and lower tables, lips 45 and 46 have a cut out portion 53 and 54 respectively (FIG. 5) for ease and gripping the table members. A pad 55 (FIGS. 1 and 11) of foam or other soft material rests on surfaces 43 and 44 and folds over when the table members are in their nested position. Suitable means may be provided for attaching pad 55 to surfaces 43 and 44, but they are not shown in the drawings.

Figures 10, 11, 12:
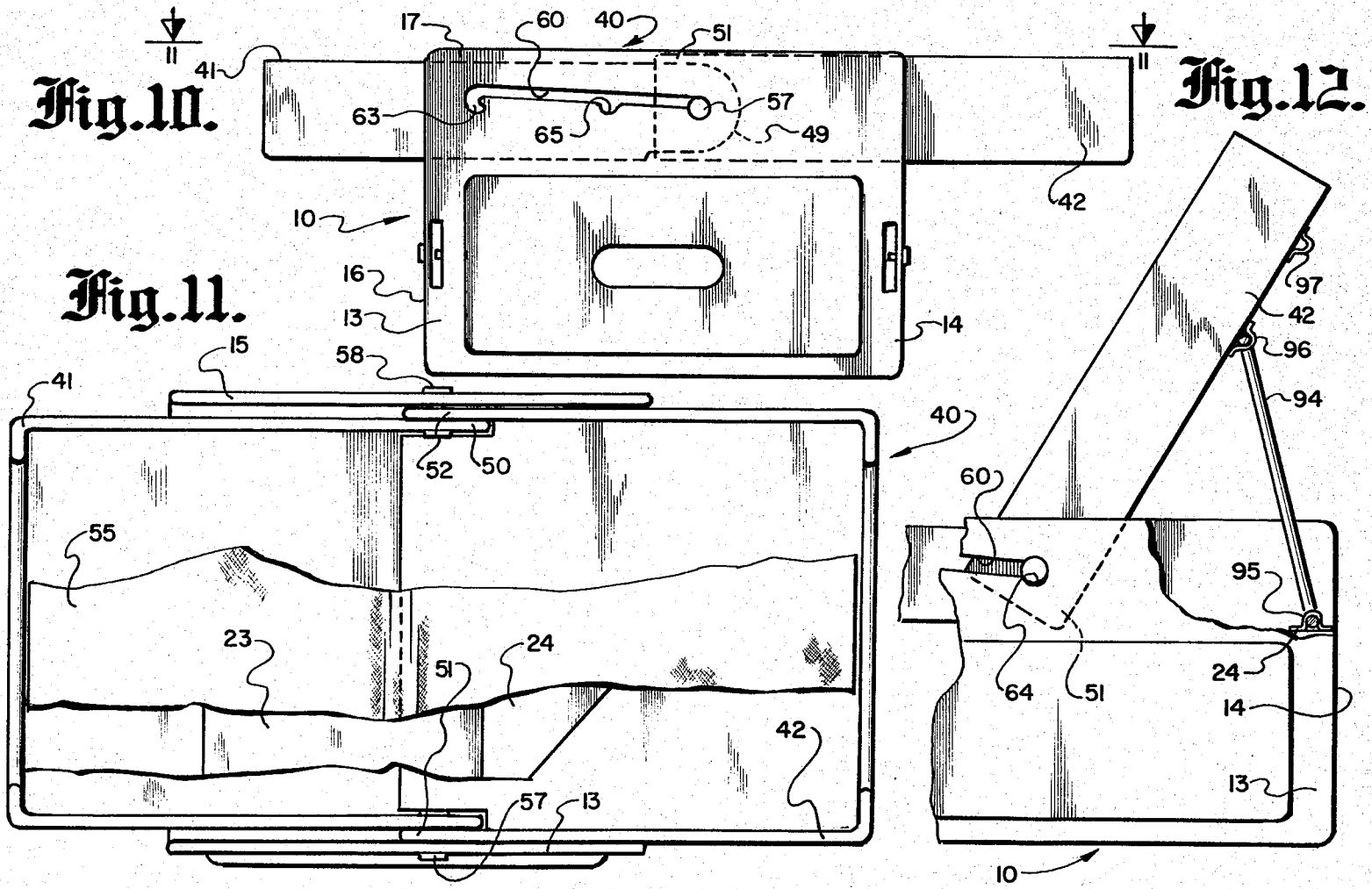
FIG. 10 is a front elevation of the device of the present invention with the table members in their fully opened position.
FIG. 11 is a plan view of the device in the same position.
FIG. 12 is a partial front view of the device of the present invention with one of the table members elevated so that the infant can sit up.

Upper and lower table members 41 and 42 hinge or pivot with respect to each other generally from a nesting position show in FIGS. 1, 4 and 5 to an open or flat position shown in FIG. 10 or 11. As explained in more detail below, one of the table members such as table 42 can be pivoted and braced upward (FIG. 12) so that the table sections can act as a chair or both can lay flat (FIGS. 10 and 11). Lips 45 and 46 each have extensions 49 and 50 and 51 and 52, respectively (FIGS. 1, 2 and 9–12), which extend toward the open ends of upper and lower tables 41 and 42.

Securing means on the upright wall means above the upper support surfaces are used to attach the infant support member to the upright wall means. In the exemplary embodiment, the securing means comprises headed shafts 57 and 58, which extend through openings in extensions 49–52 (FIG. 2) and through openings 60 and 61 in upright walls 13 and 15 (FIG. 2). The openings through extensions 49 and 50 of upper table member 41 pivot around shafts 57 and 58 such that tables 41 and 42 can move between the various positions shown in the drawings.

As shown in FIGS. 1, 10 and 12, openings 60 and 61 are slots through the upper portions 17 and 18 of upright walls 13 and 15. Shafts 57 and 58 slide in slots 60 and 61 so that the table members can be correctly positioned over the base member 10. In their nesting position, it is desired that the table members 41 and 42 not extend beyond walls 14 and 16 (FIG. 1). However, when opened to the FIGS. 10, 11 and 12 positions, it is important that the center of gravity of the infant/table combination be located above base member 10 inside the planes of upright walls 13–16 so that the entire apparatus does not tip when an infant is on table members 41 and 42. Thus, it is desirable to move table members 41 and 42 to the right (FIGS. 10 and 11) for proper positioning of the tables.

Slots 60 and 61 may have detents 63 and 64 (FIGS. 1, 10 and 12) that act as locating means for shafts 57 and 58 so that table members 41 and 42 are properly positioned. An additional detent 65 may also be provided intermediate to the ends of slot 60 and 61 if an intermediate, predetermined position is desirable, such as when lower table 42 raised. Slots 60 and 61 may angle somewhat so that gravity urges shafts 57 and 58 to the right (FIG. 10). The slightly higher position of the left end of slot 60 may be useful for pivoting clearance for extensions 49–52.

In addition to using detent portion 63 and 64 at the ends of slots 60 and 61, the present invention also contemplates having a ball 100 (FIG. 2) spring biased upward by spring 99 in cavity 98. At preferred locations, detents 59 are provided in bottom table member 42. When ball 100 is engaged in one of the detents 59, table members 41 and 42 will be secured in a position unless one supplies additional lateral force to table members 41 and 42 to disengage ball 100 from one of the detents 59. Another possibility is to hinge hoods on upper portions 17 and 18 near the ends of slots 61 and 62 that engage the end of shafts 57 and 58.

Hinge preventing means on the infant support members prevent the table members from pivoting with respect to each other. The hinge prevention system may take many forms. In one exemplary embodiment, hinge preventing means 70 includes pin 70 (FIGS. 1, 6, 7 and 8) which comprises a shaft 71 inserted in opening 73 extending through lips 45 and 46 and upper portion 17 of wall 13. A single pin 70 will hold tables 41 and 42, but a second pin through wall 15 can also be used. Shaft 71 has an upright projection 72 and a base 74. When pin 70 is in its FIG. 6 configuration, projection 72 rests against the inside wall of lip 45 to prevent pin 70 from being removed. Handle 75, whose shape is best shown in FIG. 1, attaches to base 74 through opening 76 (FIG. 6), and the handle engages cam 77 (FIG. 8). Spring 79 pushes against block 78, which in turn is urged against cam 77 to maintain the handle in its downward position against the outside of the upper portion 17 of wall 13. When upper and lower tables 41 and 42 are to be released, handle 75 is pivoted upward to its position in phantom in FIG. 8. Cam 77 pushes on block 78 which in turn moves internal shaft 80 and projection 72 to the left. The entire pin 70 is then rotated upside down, and projection 72 can be pulled through opening 73 until it contacts shoulder 81, which prevents pin 70 from being entirely removed from opening 73 so that it is not removeable where it could be lost. When no portion of shaft 71 or projection 72 is within the portion of opening 73 in lips 45 and 46, the table members 41 and 42 can be pivoted upward.

An alternative to the pin arrangement shown in FIGS. 6–8 is shown in FIG. 9. There a rounded pin 81 is attached to the top of upper table 41, and a similar pin 82 is attached to wall 14. An elastic rope 83 is fixed to pin 82, and its opposite end has a loop than can be fit over pin 81 when rope 83 is stretched. In its FIG. 9 position, elastic rope 83 will hold the upper and lower tables 41 and 42 in the nested position.

It is also possible that by properly designing the shape of shaft 57 (FIG. 2) and shaft 58 and the openings through extensions 49, 50, 51 and 52 as well as the shape of slots 60 and 61, that moving the shafts 57 and 58 to a specific position on slots 60 and 61 would also lock upper table to lower table in its FIG. 1 nested position.

An opening in at least one of the upright walls or through the base allows for access to the central cavity. The opening into the cavity 21 can be closed by a hinged door, but it is preferable to use a drawer. Also, although there could be a drawer from two sides of the main body divided for specific functions (e.g. clean diapers versus dirty ones or diapers and clothing versus food), the exemplary embodiment only has one drawer.

Molded plastic drawer 86 (FIGS. 5 and 9) is mounted in cavity 21 and slides along rails 87 and 88 molded into base 12 (FIG. 9) drawer 86 is preferable formed of light-weight, plastic material. It is secured in cavity 21 in that in the fully closed position (FIG. 5) with base 91 of drawer 86 against wall 13, the bottom lip 26 of drawer opening 27 fits into indentation 89 on the front of bottom wall 90 of drawer 86. In order to open drawer 86, handle 92 (FIGS. 4 and 5) is engaged and lifted upward to disengage lip 26 from indentation 89. Thus, drawer 86 can be secured inside cavity 21. An auxiliary lock can also be provided. This may take the form of a spring bias pushing indentation 89 against lip 26 so that even if the device is in a different orientation from that shown in the drawings, lip 26 will still engage indentation 89. Also, conventional securing locks can be provided to maintain drawer 86 in its closed position.

Another way to provide access to cavity 21 is through an opening in upper support surface 24. As shown in FIG. 11, the left side of the upper support surface has an opening 23. When the tables 41 and 42 are nested (FIG. 1) opening 23 is covered. For access, one slides tables 41 and 42 to the right along slots 61 and 62. The advantage of opening 23 is that it eliminates the need for a drawer. There is a disadvantage in that one has no access to cavity 21 when an infant is on tables 41 and 42 in their opened positions (FIGS. 10, 11 and 12).

Other handles similar in shape to handle 92 in drawer 86 such as handle 93 (FIG. 1) can be molded into the plastic upright walls 14, 15 and 16 for additional means for holding and transporting the device of the present invention.

Additionally, a carrying strap releasably attachable to the main body is also provided. In the exemplary embodiment, strap 29 is formed of nylon or other suitable strapping material. Its length can be adjusted by means of a conventional loop-type adjusting device 30. An intermediate pad 31 may be provided for cushioning the strap on one's shoulder. The ends of strap 29 are looped through tongues 32. When the tongues are inserted through openings 33 (FIGS. 1 and 3), pin 36 with an angled front face is urged to the right to pivot arm 35 counter-clockwise against bias from spring 37 pushing on shaft 39. Alternatively, button 38 can be depressed to pivot arm 35 to move pin 36 out of the path of tongue 32 being inserted in opening 33. When tongue 32 reaches its FIG. 3 orientation, spring 37 will urge shaft 39 to pivot arm 35 clockwise to engage pin 36 in opening 34. When tongues 32 on both ends of strap 29 are so engaged, the strap can be used for carrying the entire device.

There are also many other ways of attaching the strap to main body 10. Spring closing safety hooks could replace tongues 32 and engage suitable openings.

The invention also provides the possibility of using strap 29 to assist in restraining an infant. In FIG. 1 another release button 38 is present on the other end of main body 10. Strap 29 can therefore be attached over table members 41 and 42. If strap 29 is properly tightened, it can restrain in infant.

In use, for sleeping or for using as a diaper changing table, table members 41 and 42 will normally be used in their fully opened (FIGS. 10 and 11) position. If it is desired to have the infant sit up, a brace is pivotally mounted on bracket 95 in a convenient location on body member 10. In the exemplary embodiment, bracket 95 is mounted at one end of the upper support surface 24 (FIG. 9). Bracket 94 may be constructed of bent metal or other suitable material. A number of spaced-apart receiving brackets 96 and 97 are provided on the top surface of table member 42. By choosing the receiving bracket 96 and 97, the angle of table member 42 is determined, and an infant may be propped up using an elevated table member. Bracket 94 is stored between upper support surface 24 and the underside of table member 42 (FIG. 9).

I claim:

1. A device for transporting infant supplies and for supporting an infant comprising a main body having upright wall means comprising a plurality of generally upright walls connected on their sides to adjacent upright walls forming a central cavity inside the upright walls, an upper support surface extending inward from the upright wall means below the top edge of the upright wall means, an infant support member on the upper support surface comprising a pair of table members hinged with respect to each other, and securing means on the upright wall means above the upper support surface for attaching the infant support member to the upright wall means.

2. The device of claim 1 wherein the upright wall means comprises at least two parallel upright walls, a slot extending along each of the parallel upright walls, the securing means extending into the slots for sliding the infant support member to a desired position on a upper support surface.

3. The device of claim 2 further comprising detent means on at least one end of the slot for holding the securing means at a desired location on the slot for retaining the infant support member in a fixed position on the upper support surface.

4. The device of claim 1 wherein each table member includes upstanding walls extending substantially around all but an open edge to form a lip substantially around the infant support member when the table members are opened relative to each other, a shaft extending through the upstanding walls at both sides of the open edge acting as a pivot for hinging the table members to each other, each shaft having an extension extending into the slot on the corresponding upright wall.

5. The device of claim 3 further comprising locking means on the upper support surface for preventing the infant support member from sliding along the upper support surface.

6. The device of claim 5 wherein the locking means comprises an opening in at least one wall member adjacent the table members when the table members are folded over relative to each other, the locking means having a pin extending through the opening to engage at least one of the table members to prevent it from pivoting with respect to the main body.

7. The device of claim 1 further comprising hinge prevention means movable between a blocking and an unblocking position on the infant support member for preventing in the blocking position the table members from pivoting with respect to each other and for permitting such pivoting when the hinge preventing means is in the unblocking position.

8. The device of claim 1 further comprising an opening into the main body for access to the central cavity and means for closing the opening.

9. The device of claim 8 wherein the opening is in the upper support surface, the infant support member sliding on the upper support surface opening and closing the opening.

10. The device of claim 1 further comprising an opening in at least one of the upright walls for access to the central cavity and means for closing the opening.

11. A device for transporting infant supplies and for supporting an infant comprising a main body having upright wall means comprising a plurality of generally upright walls connected on their sides to adjacent upright walls forming a central cavity inside the upright walls, an upper support surface extending inward from the upright wall means below the top edge of the upright wall means, an infant support member on the upper support surface for attaching the infant support member to the upright wall means, securing means on the upright wall means above the upper support surface for attaching the infant support member to the upright wall means, an opening in at least one of the upright walls for access to the central cavity and means for closing the opening, and a drawer in the central cavity moveable in and out of the opening for convenient storage of items in the central cavity.

12. The device of claim 11 further comprising drawer closure means between the drawer and the main body for maintaining the drawer in a closed position.

13. The device of claim 1 further comprising a strap releasable attachable to the main body for carrying the device.

14. The device of claim 13 further comprising attaching means on both sides of the infant support member for attaching the strap over the infant support member in its open position to act as a means for holding the infant to the table members.

15. The device of claim 1 wherein the pair of table members hinged with respect to each other can move between at least three positions, a closed position in which one table member is over the other table member, a second position in which one table member is at an angle to the other table member, and a third position in which the two table members are generally in the same plane.

16. The device of claim 15 further comprising support means extending between the main body and one of the table members when the table members are in there second position for holding the one table member in its second position.

* * * * *